US009415251B2

(12) United States Patent
Mariller

(10) Patent No.: US 9,415,251 B2
(45) Date of Patent: Aug. 16, 2016

(54) SYSTEM, IN PARTICULAR, FIRE-FIGHTING SYSTEM WITH VALVES

(71) Applicant: PHOENIX FIREFIGHTING TECHNOLOGIES S.A., Romanel sur Lausanne (CH)

(72) Inventor: Alain Mariller, Le Mont-Pelerin (CH)

(73) Assignee: PHOENIX FIREFIGHTING TECHNOLOGIES S.A., Romanel sur Lausanne (CH)

( * ) Notice: Subject to any disclaimer, the term of this patent is extended or adjusted under 35 U.S.C. 154(b) by 0 days.

(21) Appl. No.: 14/694,947

(22) Filed: Apr. 23, 2015

(65) Prior Publication Data

US 2015/0297928 A1 Oct. 22, 2015

Related U.S. Application Data

(62) Division of application No. 11/791,479, filed as application No. PCT/IB2005/053956 on Nov. 29, 2005, now abandoned.

(30) Foreign Application Priority Data

Nov. 29, 2004 (CH) ..... 1969/04

(51) Int. Cl.

| | |
|---|---|
| ***A62C 35/00*** | (2006.01) |
| ***A62C 35/68*** | (2006.01) |
| ***A62C 35/64*** | (2006.01) |
| ***A62C 35/62*** | (2006.01) |

(52) U.S. Cl.
CPC ..... *A62C 35/68* (2013.01); *A62C 35/62* (2013.01); *A62C 35/64* (2013.01)

(58) Field of Classification Search
CPC ..... A62C 35/68; A62C 35/64; A62C 35/62; A62C 37/11
USPC ..... 169/16, 19, 20, 60
See application file for complete search history.

(56) References Cited

U.S. PATENT DOCUMENTS

| | | | | |
|---|---|---|---|---|
| 6,224,198 | B1 * | 5/2001 | Cook | B41J 2/17506 347/85 |
| 6,591,201 | B1 * | 7/2003 | Hyde | G01F 25/0007 700/281 |
| 2005/0095139 | A1 * | 5/2005 | Schurter | E03B 11/02 417/38 |
| 2006/0102749 | A1 * | 5/2006 | Crabtree | A62C 31/02 239/410 |
| 2007/0051408 | A1 * | 3/2007 | Eichler | F16K 17/30 137/460 |

* cited by examiner

*Primary Examiner* — Davis Hwu
(74) *Attorney, Agent, or Firm* — Nixon & Vanderhye P.C.

(57) ABSTRACT

The system comprises a main network situated downstream from a check valve that supplies the sensors, for example, in the form of sprinklers. This main network is subdivided into secondary networks, each secondary network being isolated from the main network by a valve that enables water to be prevented from entering the portions of the network in which it is not needed. The valve is capable not only of compensating for losses in pressure in the network but also for opening itself completely when a fire is detected.

13 Claims, 5 Drawing Sheets

SYSTEM, IN PARTICULAR, FIRE-FIGHTING SYSTEM WITH VALVES

This application is a divisional of U.S. patent application Ser. No. 11/791,479 filed on 24 May 2007, which is the US national phase of international application PCT/IB2005/053956 filed 29 Nov. 2005, which designated the U.S. and claims benefit of Switzerland patent application CH 01969/04 dated 29 Nov. 2004, the entire contents of which are hereby incorporated by reference.

FIELD OF THE INVENTION

The present invention relates to the field of valves, particularly valves for fire-fighting systems, but also valves used in the medical domain, for example in systems for injecting and metering drugs, regulating pressure, treating blood, etc.

PRIOR ART

Fire-fighting systems of the sprinkler type are well known in the prior art. These systems are used as automatic fire-fighting systems. They allow the location at which the fire has broken out to be dowsed quickly by being triggered in response to the sensing of heat. As soon as the temperature has reached a certain value (typically of the order of 68° C.) the sprinkler head ruptures and water is sprinkled onto the location concerned. The effectiveness of such systems is recognized and they are in very widespread use.

There are three main types of sprinkler system and these are as follows:

- wet systems: these are the least expensive and the most effective. The pipe is permanently full of pressurized water. When a sprinkler head is ruptured, the water is sprayed out immediately and allows the fire to be extinguished quickly;
- foam installations;
- dry systems: these operate on a principle similar to wet systems but are used when the pipes are subject to freezing and are therefore filled with pressurized air rather than water. The main disadvantage is the time it takes for water to reach the sprinkler.

One conventional type of dry sprinkler system is depicted schematically in FIG. 1. On one side, the water arrives at a pressure of the order of 16 bar and is halted by a differential pressure check valve 1. On the other side of the check valve 1, the pipes 2, 2', 2", 2'" are under air pressure at about 1.5 to 4 bar. The air pressure is kept at the desired value between the check valve 1 and the sprinkler heads 3', 3", 3'" (which are in the form of groups) by a compressor 4 which is able to compensate for leakage losses. The way the system works in the event of a fire is as follows: when a sprinkler head 3 ruptures, its opening allows the pressurized air present in the pipes 2, 2', 2", 2'" to be released through the head. The air pressure, because it drops, becomes too low to keep the check valve 1 closed. In opening, the check valve 1 allows water to enter the pipes 2, 2', 2", 2'" and to dowse the detected fire. An alarm linked to the various groups of sprinkler allows precise location of which group gave rise to the alarm and therefore where the fire is located.

Current safety standards demand that the sprinklers 3 be grouped together (with a maximum Surface area of 5000 $m^2$ per group) so that the location of the incident can be determined with precision. The only method known to date is to use a different hydro-pneumatic combination for each group of sprinklers 3', 3", 3'". If the location in which a fire-fighting system is fitted covers several storeys, it is also necessary to scale up the number of hydro pneumatic combinations accordingly.

The cost of such a unit may be as much as CHF 10,000 and, what is more, depending on the configuration of the building to be protected, numerous pipes are led out in parallel to reach the various points required. Furthermore, the number of combinations also makes the testing that has to be carried out regularly on this kind of system more complicated and increases the sources of potential problems.

In addition, all of the secondary networks 2, 2', 2", 2'" connected to one hydro-pneumatic combination and its check valve 1 have to be completely filled before the pressure reaches its maximum in the sprinkler group concerned, and this causes time to be lost because of the size of such systems, and this delay could prove critical when fire fighting, a situation in which the first minutes or even seconds are of vital importance. For this reason, official standards also define the maximum permissible amount of time that the water can take to reach the group of sprinklers 3', 3", 3'" furthest from the check valve 1.

Another problem faced in dry systems is that of the time it takes for the air to be released from the network when a fire breaks out. Indeed, when the lengths of such networks are taken into consideration, it is necessary to operate on as low a pressure as possible in that part of the network which lies downstream of the check valve 1 in order to minimize this release time. To solve this problem, a kind of air release accelerator in the form of a valve at the end of the network has been added. This valve makes the system more complicated and requires an individual control. In addition, the entire network will none the less fill with water, a situation which from this viewpoint is no improvement over systems which do not have air release accelerators.

Finally, in such networks of pipes which may stretch over several kilometers, with numerous bends and unions, there is always a problem of pressure drops in the part downstream of the check valve 1. To compensate for these drops and to maintain the pressure that keeps the check valve 1 closed, use is made of compressor 4 which injects pressurized air into the network when needed (see FIG. 1).

SUMMARY OF THE INVENTION

It is an object of the invention to improve the known systems and overcome the abovementioned disadvantages.

More specifically, the invention seeks to propose a dry fire-fighting system which works better than the known systems while at the same time remaining of acceptable cost.

From a more general standpoint, it is an object of the invention to propose a system that can be applied to various technical fields, in addition to the fire-fighting system field, particularly the medical field.

One idea of the invention is to subdivide the network downstream of the water check valve into several sub-networks, each sub-network being isolated by an individual valve, thus making it possible to prevent water from entering the parts of the network where it is not needed, hence improving performance.

Another idea of the invention is to propose such an intermediate valve which is capable both of compensating for the pressure drops in the network and also of opening fully when a fire is detected.

The invention is described in greater detail hereinafter using examples illustrated by the figures attached to this application.

DETAILED DESCRIPTION OF THE INVENTION

Figure 1:
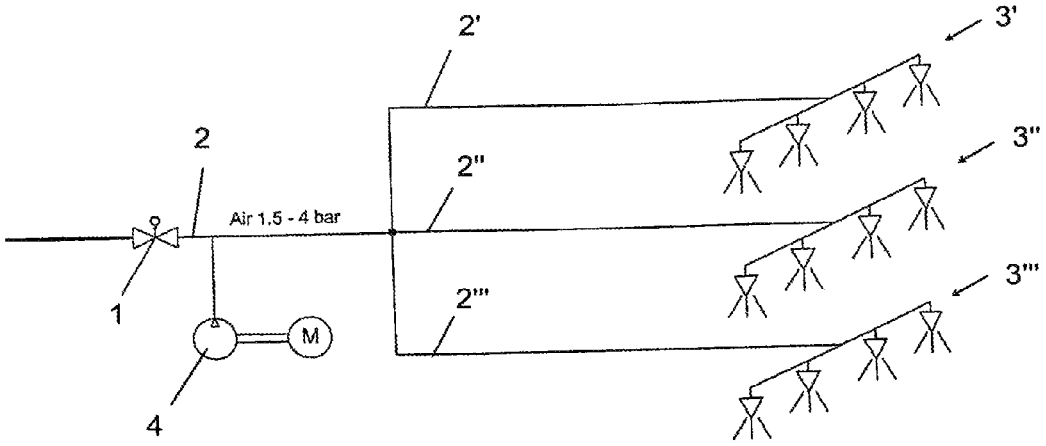
FIG. 1 is a block diagram of a fire-fighting system according to the prior art.

FIG. 1 has already been described hereinabove in relation to the prior art.

Figure 2:
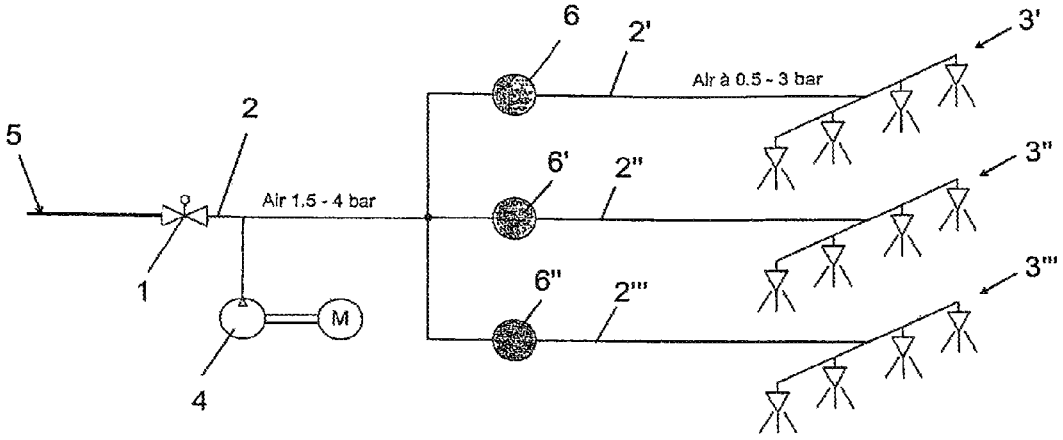
FIG. 2 is a block diagram of a fire-fighting system according to the present invention.

FIG. 2 depicts the block diagram of a fire fighting system according to the invention. This system again has a water supply 5 (typically at a pressure of the order of 16 bar) which is shut off by a check valve 1. Downstream of this check valve 1 there is an intermediate valve 6, 6', 6" on each secondary network 2', 2", 2'" of the network 2 which leads to a group of sprinklers 3', 3", 3'". In order to keep the check valve 1 closed when the groups of sprinklers 3', 3", 3'" are not affected by a fire, air is kept under pressure in the secondary networks 2, 2', 2", 2'" by a compressor 4. Typically, this air is at a pressure of the order of 1.5 to 4 bar.

In order to compensate for the pressure drops between the check valve 1 and the valves 6', 6", 6'" use is made of the compressor 4, in the conventional way. By contrast, in the pipes of the secondary networks 2', 2", 2'" there is no special compressor for doing this, because it would be too expensive. Hence, the valve according to the invention is capable of compensating for the pressure drops which occur in the branches 2', 2", 2'" of the network between the valves 6, 6', 6" and the groups of sprinklers 3', 3", 3'".

The pressure maintained between the valves 6, 6', 6" and the groups of sprinklers 3', 3", 3'" is typically of the order of 0.5 to 3 bar. By contrast, the pressure maintained between the check valve 1 and the valves 6, 6', 6" is typically of the order of 1.5 to 4 bar, therefore 1 bar higher than the pressure indicated above.

Figure 3:
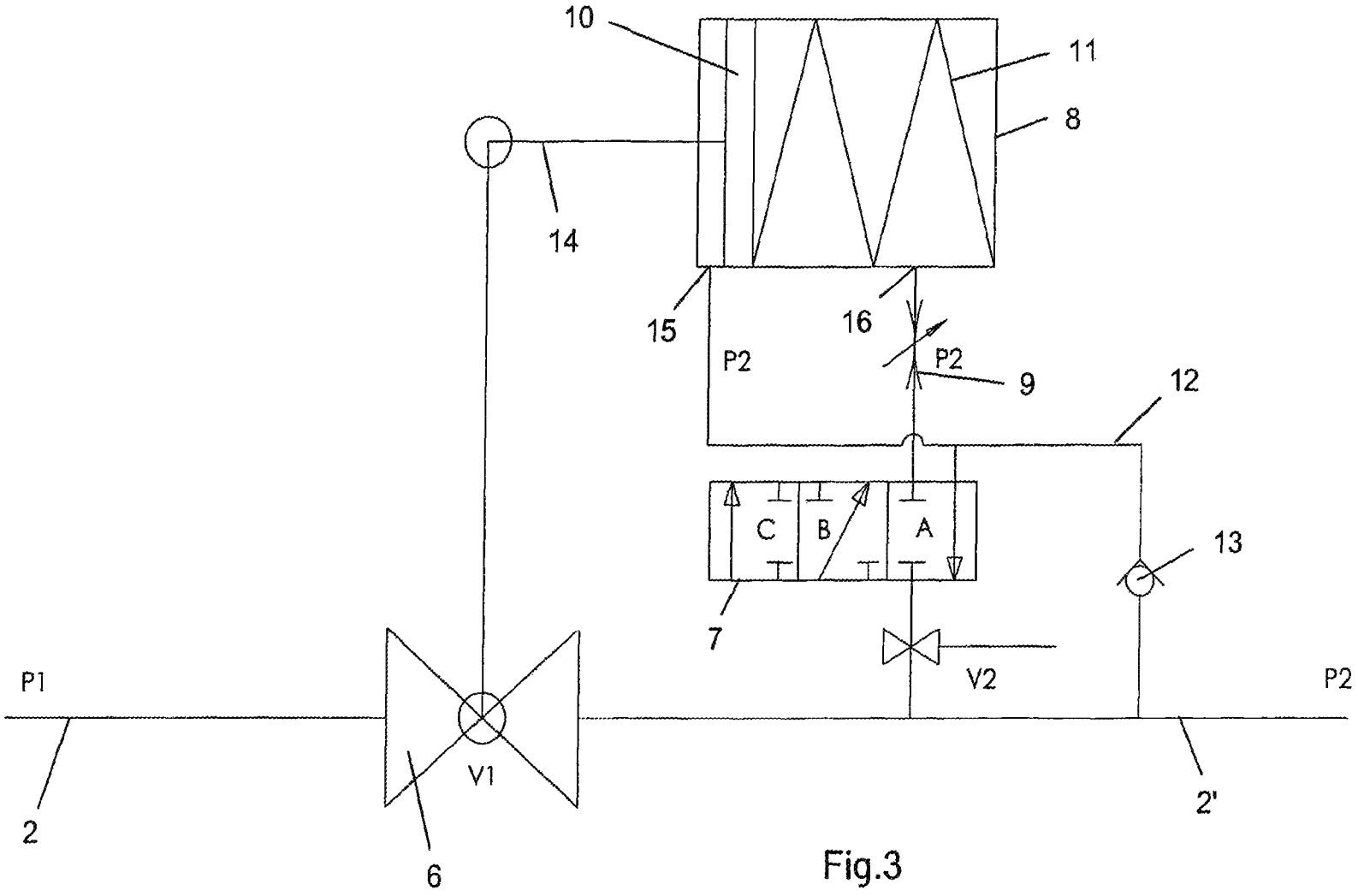
FIG. 3 is a block diagram of the valve according to the invention.

The operation of the valves 6', 6", 6'", which are identical, and the way their controls work is explained in more detail in relation to FIG. 3 and the example illustrated nonlimitingly in FIGS. 4 to 6 and 4A, 5A and 6A respectively.

In FIGS. 3 to 6, 4A to 6A, the elements which have already been described hereinabove in relation to FIGS. 1 and 2 keep the same references. So once again there is the pipe 2 (upstream side) arriving on one side of the valve 6 and the pipe 2' leaving the other side of the valve 6 (the downstream side). The figures also show the mechanism for compensating for leaks downstream of the valve 6.

This mechanism comprises in particular a three-way valve 7 with three positions A, B and C, which is connected on one side to the pipe 2' and on the other side to a cylinder 8 through a restrictor 9. The cylinder comprises a piston 10 actuating the valve 6 (thus allowing it to be opened or closed) and a spring 11 driving the piston 10 toward the left-hand side of the figure in the cylinder 8.

The cylinder 8 is additionally connected to the pipe 2' by a commissioning pipe 12 which comprises a nonreturn element 13 and allows the pressure to be dumped from the piston without delay.

Using this system it is possible to compensate the pressure drops in the downstream pipe 2' by using the higher pressure present in the upstream pipe 2 in the way explained hereinafter.

Position A of the valve 7 (see FIGS. 3, 4 and 4A) corresponds to the rest position in which the system can be emptied. The valve V2 is a bleed valve. It bleeds the pipe of all the impurities upstream before sending pressure to the valve according to the invention.

Figures 4, 4A:
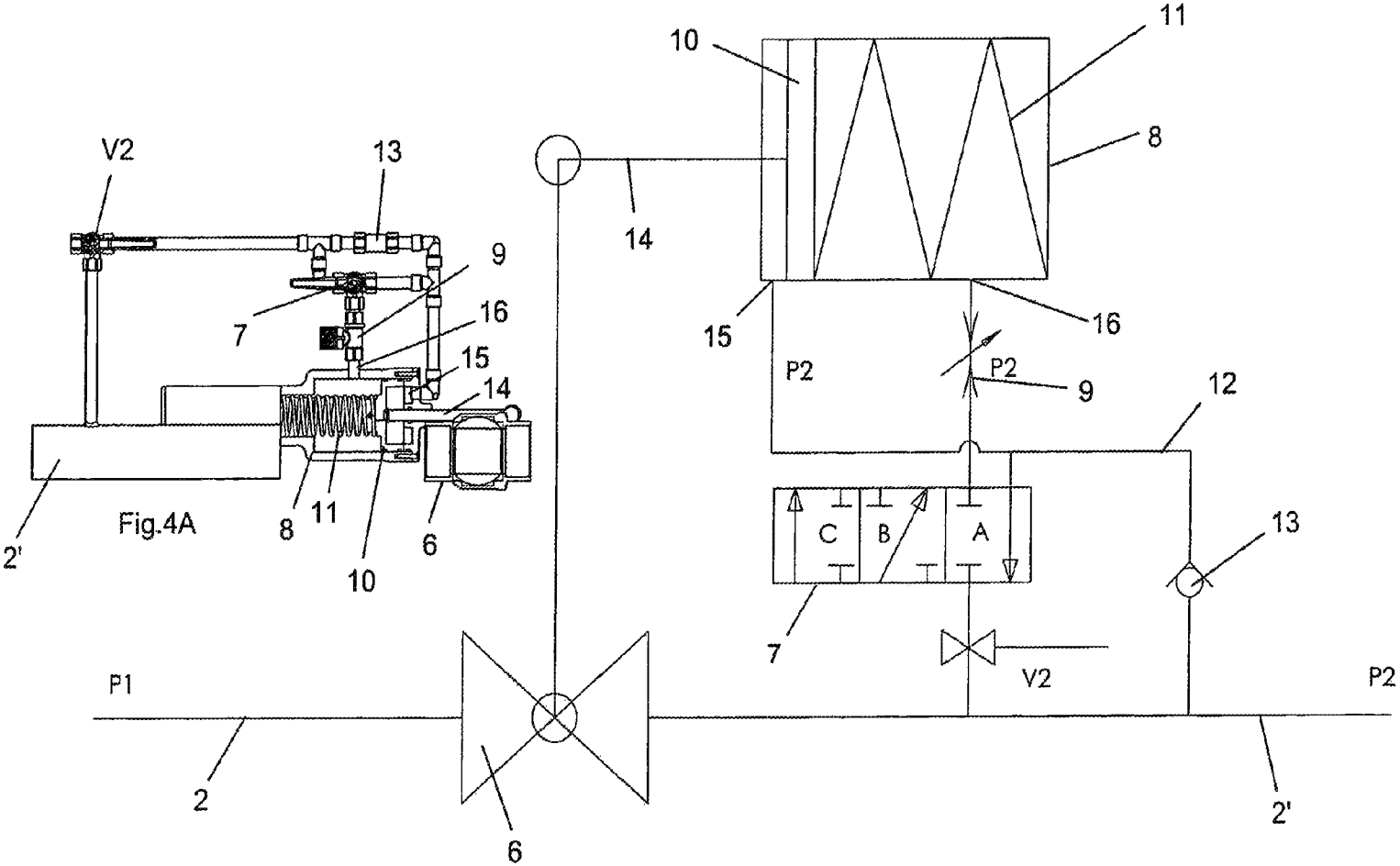
FIGS. 4 and 4A illustrate the system according to the invention, at rest.
Figures 5, 5A:
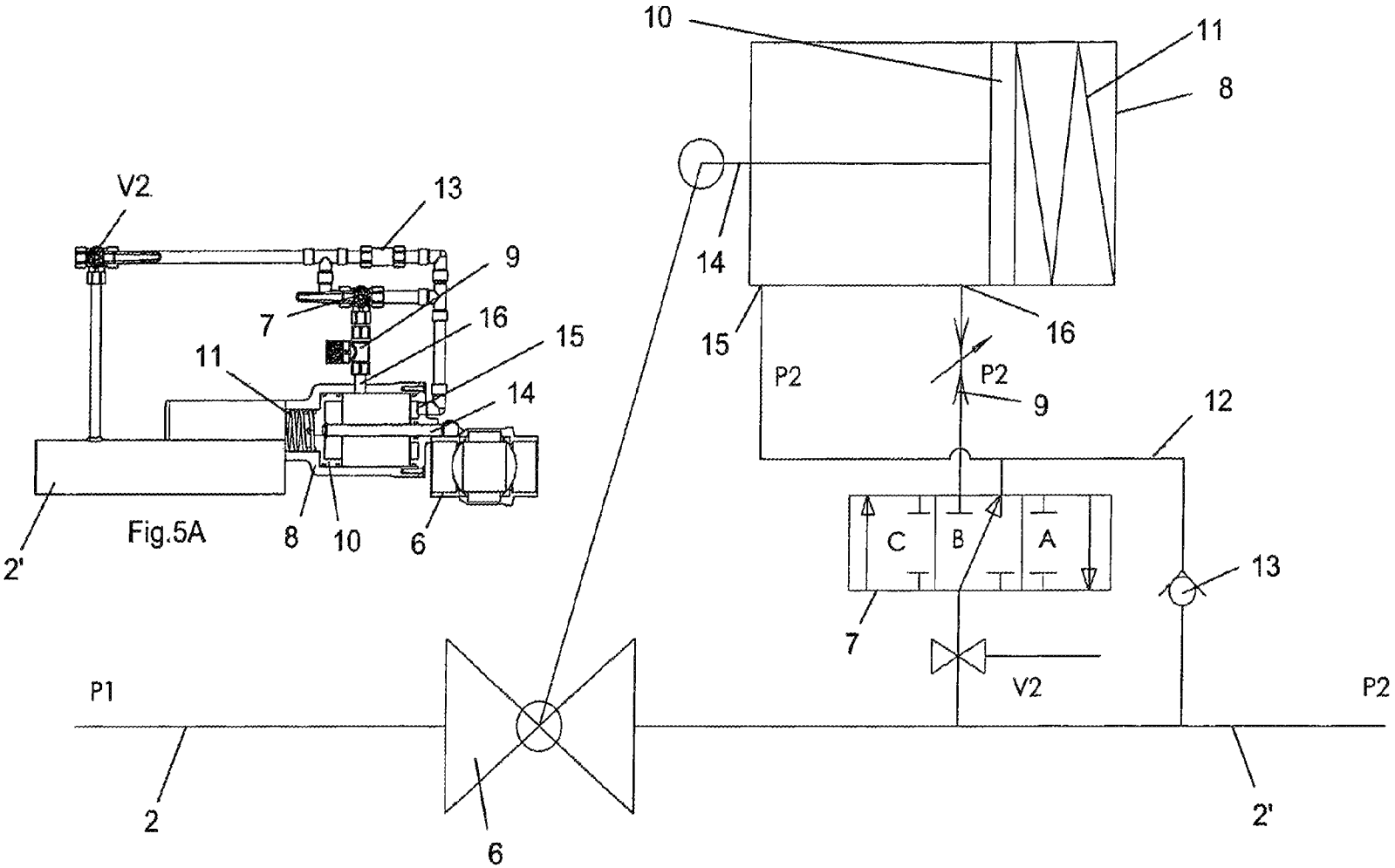
FIGS. 5 and 5A illustrate the system according to the invention set and ready to operate.

In position B (see FIGS. 3, 5 and 5A) the system can be commissioned. At the start of this procedure, as depicted in FIG. 4, there is no raised pressure over atmospheric pressure (1 bar), all the pressure values indicated in this application incidentally being gauge pressures (which need to be added to normal atmospheric pressure). Thus, the piston 10 is driven right to the end (to the left in FIG. 4 or to the right in FIG. 4A) of the cylinder 8 by the spring 11. In this position, an actuating means 14 (for example a rod) acts on the valve 6 to open it. The starting of the compressor 1 injects pressurized air into the network 2, through the valve 6 (which is open), into the network 2' as far as the sprinklers 3', 3", 3'". The pressurized air also passes through the valve 7 (in position B) and into the pipe 12 and fills the cylinder 8 in front of the piston 10 via the passage 15. The valve 7 is kept in this configuration and this mode of operation is maintained in order to push the piston 10 back toward the top of the cylinder 8 (to the right in FIG. 5 or to the left in FIG. 5A), compressing the spring 11. At the end of commissioning, the system is set and ready to operate.

As soon as the piston has moved past the second passage 16 connected to the restrictor 9, it is possible to enter the standard operating mode that allows for compensation and corresponds to position C of the valve 7.

Figures 6, 6A:
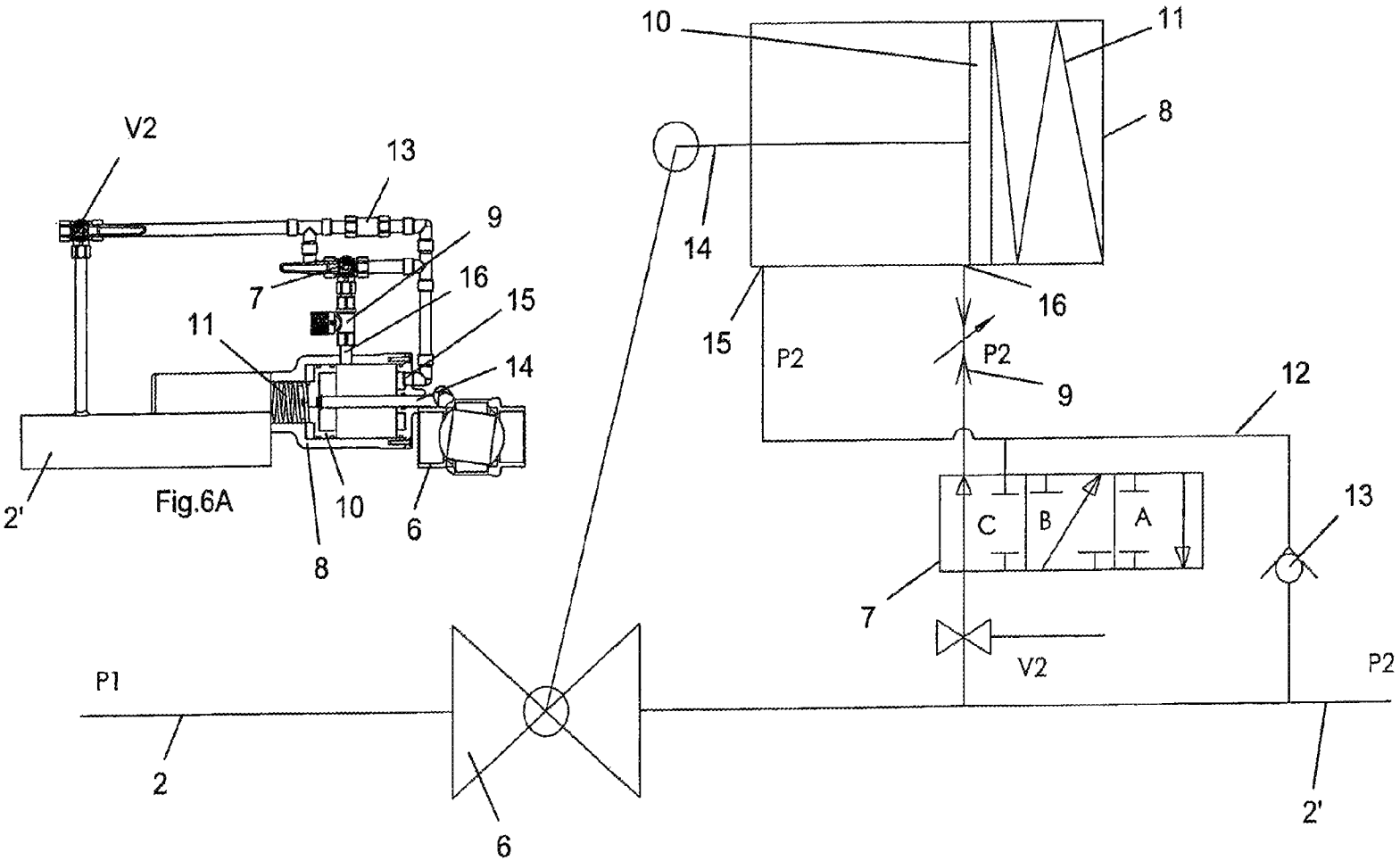
FIGS. 6 and 6A illustrate the system according to the invention during compensation.

The compensation mode of operation is depicted in FIGS. 6 and 6A. The volume in the cylinder 8 which lies in front of the piston 10 (to the left in FIG. 6 or to the right in FIG. 6A) makes it possible to set the position of the piston 10 and therefore the openness of the valve 6. In effect, at the end of commissioning, the entire section downstream of the valve is in equilibrium at the same pressure (P2 in the figure), which is predetermined. Leaks will cause the pressure in the pipes 2' and 12 to drop (through the nonreturn element 13) and correspondingly the pressure in the volume of the cylinder will reduce through air escaping through the passage 15. This reduction in the volume will allow the spring 11 to move the piston 10 to the left (FIG. 6) or to the right (FIG. 6A) and this will have the effect of opening the valve 6. Of course, these movements are of small amplitude because they are created by leaks in the pressurized air network.

With the valve 6 slightly open, the air which is kept at a pressure higher than about 1 bar upstream of the valve 6, by the compressor 4, will be released into the pipe 2' through the valve 6. This air, which cannot enter the volume of the cylinder through the passage 15 because of the nonreturn element 13 will, by contrast, pass through the valve 7 and the restrictor 9 to ultimately enter the volume of the cylinder 8 and drive the piston 10 back (to the right in FIG. 6 or to the left in FIG. 6A), which has the effect of closing the valve 6 again. In this way it is possible to compensate for the pressure drops in the network downstream of the valve 6 without adding a compressor but simply using the one which acts on the upstream pipe 2.

The restrictor 9 has a delaying effect in that it prevents the system from returning to a state of equilibrium immediately and makes it possible to ensure that the valve 6 is correctly closed by using the volume of the downstream network as a pressure reservoir.

In the event of a fire, the operation is as follows. One sprinkler head, for example 3', ruptures so that the air present in the pipe 2' downstream of the valve 6 is released. The pressure in the cylinder decreases, causing the piston to move to the left in FIGS. 4 to 6 or to the right in FIGS. 4A to 6A. As the valve 6 is unable to compensate for such a drop, the piston continues to move beyond the point 16, thus no longer allowing any further compensation. The piston ends its travel in abutment. The system is then in an alarm situation, with the valve 6 wide open. The compressor 4 in its turn is unable to compensate for the drops due to the release of the air. The upstream pressure drops and the check valve 1 opens thus allowing water to flood into the pipes to reach the sprinkler group 3' which caused the alarm. Because of the presence of the valves 6', 6" isolating the branches 2" and 2'", the water does not enter the branches of the pipes which supply the sprinkler groups 3" and 3'", hence saving a significant amount of time in the arrival of water at the sprinkler group 3' because there is no longer any need to raise the pressure in all of the branches 2', 2" and 2'".

The embodiments given hereinabove are so by way of example and these concepts can be generalized using the elements and the principles of the invention for other applications requiring a similar kind of operation, namely a system in which, in one state, a fluid is kept at an upstream pressure by means of a fluid at a lower downstream given pressure shut off at a check valve and, in another state, the fluid is allowed to pass by enabling the check valve if the pressure downstream drops below a predetermined pressure.

The elements involved in opening and shutting of the main pipe of a sprinkler network, that is to say the check valve, may be as follows:

- ball valve
- wedge valve
- spherical valve
- wedge gate valve
- knife gate valve
- butterfly valve
- clack valve maintained mechanically or with a differential area
- or the like.

The compensating of the downstream pressure performed by the system according to the invention may be internal to the opening and shut-off elements or external thereto. Furthermore, the compensation may be achieved with or without delay in opening/closing and may be performed in advance of or otherwise the opening/closing of the regulating control.

The regulating controls for providing compensation or introducing an alarm situation (opening or closing down the system) may be as follows:

- pneumatic controls
- electrical controls
- mechanical controls
- or the like.

For example, it is possible to conceive of an actuator comprising electronic controls using, as its regulating parameters, the upstream and downstream pressures and commanding the opening/closure of the valve on the basis of these values in a way equivalent to that described hereinabove.

By way of trip element, which is a sprinkler in the embodiment described hereinabove, it is possible to imagine other types of sensors that perform the same function. Apart from heat detectors, use may be made of a pressure sensor or of any other type of sensor that may be beneficial to the application in question.

Of course, the system according to the invention can be coupled to the pipework using the following systems:

- welds
- flanges
- screwed couplings
- quick coupling or crimped coupling systems.

The system according to the invention needs to transmit an alarm when it is opened and closed. This alarm raised using electrical, pneumatic, mechanical or other contacts.

The open/close command allows action on the main valve of the invention by a system involving an electric motor, a pneumatic actuator, a hydraulic actuator, an oleopneumatic actuator or alternatively a mechanical actuator.

Of course, the elements indicated hereinabove can be selected freely according to the application to be made by applying the principles of the invention.

LIST OF NUMERICAL REFERENCES

1 Check valve
2 Main network
2', 2", 2'" Secondary network
3', 3", 3'" Group of sprinklers
4 Compressor
5 Water supply
6, 6', 6" Valve
7 Three-position valve
8 Cylinder
9 Restrictor
10 Piston
11 Spring
12 Network
13 Nonreturn element
14 Actuating means 14 (for example a rod)
15 First passage
16 Second passage
V2 Valve

The invention claimed is:

1. A network system comprising at least one supply of pressurized liquid, a check valve, a master network connected on one side to said check valve and on the other side to several branches each connected to at least one trip element sensitive to a predetermined parameter, and an element supplying a pressurized fluid to said master network, said trip element allowing the network to be opened and vented to atmospheric pressure, this venting to atmospheric pressure opening the check valve in such a way as to allow the network and its branches to be filled with the liquid as far as the trip element, in which the connection between each branch and the network is via a valve allowing the branches not to be filled, said valve for use in a pressurized network with an upstream part and a downstream part, comprising a regulation system that is capable of maintaining a different pressure between the upstream part and the downstream part, the regulation system allowing, on one hand, to compensate the downstream pressure if the downstream pressure decreases while at the same time remains higher to a setpoint value by exclusively using the upstream pressure from the upstream part, and, on the other hand, to open the valve fully if the downstream pressure drops below the setpoint value, the regulation system comprising a piston in a cylinder connected to the downstream part by a passage comprising a restrictor, wherein the relative position of the piston to the passage determines whether the valve is in compensation mode or fully open mode.

2. The system as claimed in claim 1, wherein the liquid is water or another type of liquid.

3. The system as claimed in claim 1, wherein the fluid is air or another type of fluid.

4. The system as claimed in claim 1, wherein the trip element is a sprinkler.

5. The system as claimed in claim 1, wherein said regulating means comprise at least one actuator for opening and closing the valve, said actuator being set to give a pressure difference between the upstream part and the downstream part.

6. The system as claimed in claim 5, wherein the actuator comprises a piston in a cylinder, said piston being subjected to the force of a spring.

7. The system as claimed in claim 6, wherein said regulating means further comprise a three-way valve.

8. The system as claimed in claim 7, wherein said regulating means further comprise a restrictor.

9. The system as claimed in claim 1 wherein the network is a fire-fighting network.

10. A valve for use in a pressurized network with an upstream part and a downstream part, comprising a regulation system that is capable of maintaining a different pressure between the upstream part and the downstream part, the regulation system allowing, on one hand, to compensate the downstream pressure if the downstream pressure decreases while at the same time remains higher to a setpoint value by exclusively using the upstream pressure from the upstream part, and, on the other hand, to open the valve fully if the downstream pressure drops below the setpoint value, the regulation system comprising a piston in a cylinder connected to the downstream part by a passage comprising a restrictor, wherein the relative position of the piston to the passage determines whether the valve is in compensation mode or fully open mode.

11. The valve of claim 10, in which the regulation system comprises at least one actuator for opening and closing the valve, the actuator being set to give a pressure difference between the upstream part and the downstream part.

12. The valve of claim 11, wherein the piston is subjected to the force of a spring.

13. The valve of claim 12, wherein the regulation system further comprises a three way valve.

* * * * *